US009033266B2

(12) United States Patent
Nance

(10) Patent No.: US 9,033,266 B2
(45) Date of Patent: May 19, 2015

(54) SELF-CONTAINED AUTOMATIC ACCESS PORT UNIT FOR A COUNTERTOP, WITH METHODS OF USE THEREOF

(76) Inventor: Greg Nance, Gainesville, GA (US)

( * ) Notice: Subject to any disclaimer, the term of this patent is extended or adjusted under 35 U.S.C. 154(b) by 1442 days.

(21) Appl. No.: 12/748,965

(22) Filed: Mar. 29, 2010

(65) Prior Publication Data

US 2010/0176128 A1 Jul. 15, 2010

Related U.S. Application Data

(63) Continuation-in-part of application No. 11/879,128, filed on Jul. 16, 2007, now abandoned.

(51) Int. Cl.
*A47G 29/12* (2006.01)
*B65F 1/14* (2006.01)

(52) U.S. Cl.
CPC ..... *B65F 1/1431* (2013.01); *B65F 1/1638* (2013.01)

(58) Field of Classification Search
CPC ..... B65F 1/1426; B65F 2210/1443; B65F 1/1638; B65F 1/16; B65F 2210/168
USPC ..... 340/569; 220/211; 232/35, 52, 36, 43.2, 232/43.5; 312/272.5, 211, 212, 319.2, 325; 224/404; 241/25, 30, 33, 37.5, 46.013, 241/46.014, 46.04, 46.015; 100/215, 226, 100/227, 229 R, 229 A, 233
See application file for complete search history.

(56) References Cited

U.S. PATENT DOCUMENTS

| | | | | |
|---|---|---|---|---|
| 1,538,239 | A | 5/1925 | Claudepierre | |
| 1,579,823 | A | 4/1926 | Langguth | |
| 2,438,785 | A * | 3/1948 | McKallick | 232/35 |
| 2,474,101 | A | 6/1949 | Frothingham et al. | |
| 2,934,390 | A | 4/1960 | Wright | |
| 3,021,050 | A | 2/1962 | Rogers | |
| 3,251,486 | A | 5/1966 | Parks | |
| 3,510,055 | A | 5/1970 | Safford | |
| 3,863,561 | A | 2/1975 | Karls | |
| 4,147,100 | A | 4/1979 | Dykstra | |
| 4,183,295 | A * | 1/1980 | Peterson | 100/345 |
| 4,361,404 | A * | 11/1982 | Colin et al. | 366/2 |
| 4,489,810 | A * | 12/1984 | Curtis | 312/272.5 |
| 4,552,061 | A | 11/1985 | Brutsman | |
| 4,609,122 | A * | 9/1986 | Ziegenbein | 220/211 |
| 4,651,135 | A | 3/1987 | Duhaime et al. | |
| 4,819,883 | A * | 4/1989 | Weil et al. | 241/99 |

(Continued)

FOREIGN PATENT DOCUMENTS

JP 10007204 A 1/1998

OTHER PUBLICATIONS

U.S. Appl. No. 11/317,209, filed Dec. 23, 2005.

*Primary Examiner* — Faye Francis
(74) *Attorney, Agent, or Firm* — Dickinson Wright PLLC

(57) ABSTRACT

A self-contained automatic access port unit having a sensor that recognizes when refuse is approaching the cover, and to activate a direct current motor, solenoid, or drive cylinder which in turn moves a drive arm to open a cover to permit refuse to drop through the access port unit into a trash container therebelow, thereby avoiding the need for a user to make contact with the trash access port. A switch or timer causes the access port unit to close its cover. Motion of the drive arm is initiated by the motor, solenoid or drive cylinder, but continues through momentum imparted to the drive arm and cover. The cover engages a seal ring to provide a uniform impervious countertop surface.

20 Claims, 8 Drawing Sheets

(56) References Cited

U.S. PATENT DOCUMENTS

| | | | | |
|---|---|---|---|---|
| 4,873,811 | A | 10/1989 | Izumitani et al. | |
| 4,996,467 | A | 2/1991 | Day | |
| 5,123,339 | A | 6/1992 | Hetherington | |
| 5,329,212 | A | 7/1994 | Feigleson | |
| 5,435,484 | A * | 7/1995 | Carlson | 232/47 |
| 5,458,287 | A | 10/1995 | Jones et al. | |
| 5,667,136 | A | 9/1997 | Chen | |
| 5,797,497 | A | 8/1998 | Edwards | |
| 5,898,371 | A | 4/1999 | Marek | |
| 5,932,982 | A | 8/1999 | Pezzelli, Jr. | |
| 5,979,751 | A | 11/1999 | Maddox | |
| 6,409,064 | B1 | 6/2002 | Bayley | |
| 6,701,832 | B1 | 3/2004 | Hawkins | |
| 6,702,411 | B2 | 3/2004 | Helver | |
| 6,802,263 | B1 | 10/2004 | Kolb | |
| 6,859,005 | B2 * | 2/2005 | Boliver | 318/480 |
| 7,096,780 | B1 | 8/2006 | Hawkins | |
| 2003/0205979 | A1 * | 11/2003 | Papari et al. | 318/466 |
| 2005/0061167 | A1 | 3/2005 | Fox | |
| 2006/0196874 | A1 | 9/2006 | Yang | |
| 2007/0145057 | A1 | 6/2007 | Nance | |
| 2007/0257036 | A1 | 11/2007 | Nance | |
| 2013/0087562 | A1 * | 4/2013 | Thukral et al. | 220/210 |

* cited by examiner

SELF-CONTAINED AUTOMATIC ACCESS PORT UNIT FOR A COUNTERTOP, WITH METHODS OF USE THEREOF

PRIORITY CLAIM

The present application is a continuation-in-part application to non-provisional patent application Ser. No. 11/879,128, entitled "AUTOMATIC SOLID SURFACE ACCESS PORT AND METHOD OF USE THEREOF", filed on Jul. 16, 2007 now abandoned, and to non-provisional patent application Ser. No. 11/317,209, entitled "AUTOMATIC COUNTERTOP ACCESS PORT AND METHOD OF USE THEREOF", filed on Dec. 23, 2005, and claims priority thereto and the full benefit thereof.

FIELD OF INVENTION

The present invention relates generally to counter access openings to waste containers, and more specifically to an automatic access port unit for installation in a solid surface such as a countertop, wherein the automatic access port unit senses waste approaching a cover plate thereof and automatically opens to receive the waste and activates to dispose of the waste to a container below the counter.

BACKGROUND ART

Home kitchens typically have a trash receptacle located therein. Access to such receptacles is often required to be immediate and must be accomplished without full use of one or both hands. Accordingly, such receptacles are typically in the open for unobstructed access. However, trash containers detract from the aesthetic appearance of the kitchen and it is usually desired that such receptacles be placed out of view, if possible. Unfortunately, placing such a trash receptacle out of view typically obstructs access to the receptacle, resulting in difficulty of placing trash therein.

In addition to home kitchens, fast food restaurants have similar, but more complex, problems with disposal of trash, including food. Fast food restaurants typically serve their customers by placing food and/or beverages on a tray. Napkins, residual food, disposable utensils and food packaging remain on the tray and require disposal. Typically, a patron who has finished eating takes their tray to a trash receptacle and pushes the door of the trash receptacle inward, inserting portions of the tray into the trash receptacle opening. Empty trays are subsequently deposited on the top of, or near, the trash receptacle for recovery by restaurant staff.

Some fast food restaurants utilize a swinging side access door to a trash receptacle, while others utilize such a door disposed in the top of the receptacle. A trash receptacle, whether in a home kitchen or fast food restaurant, typically comprises a removable container with a trash bag disposed therewithin.

Unfortunately, fast food restaurant patrons must typically utilize their hand to push open the swinging door of the trash receptacle, and, at the same time, the patron must utilize their other hand to hold the tray and insert portions of the tray into the trash receptacle opening, wherein trash, including food, remaining on the tray is deposited into a trash container below the receptacle opening.

Additionally, residual food on the trays often contacts the door of the trash receptacle, resulting in an unsanitary condition, and it is undesirable for a patron to touch such door when disposing of food. Occasionally, a patron may even drop a tray into the trash receptacle, resulting in economic loss to the restaurant.

Further, some patrons may find it difficult to carry out the aforementioned actions to simultaneously open the trash receptacle door and clear trash from their tray. Young children and handicapped or disabled patrons may find it difficult to dispose of trash on their tray into such a conventional trash receptacle, as some trash may easily fall to the ground or remain on the tray. Moreover, for some disabled patrons, it may be impossible to operate a typical trash receptacle.

Various attempts have unsuccessfully been made to overcome the aforementioned disadvantages. One such invention comprises an auxiliary structure enclosure for a receptacle or receptacles for holding recyclable waste that can be attached to a building. While the enclosure conceals a receptacle or receptacles, it is external to a building, thus requiring additional space.

Other attempts to overcome the problems associated with trash disposal comprise a pivotally-mounted plate/lid horizontally disposed above a top inlet opening of a trash receptacle. To open, downward manual force must be applied to the swinging plate, causing the plate to swing downward to reveal the inlet opening of the trash receptacle. A container is positioned under the plate/opening for receiving trash. Through counterbalance weighting or springs, the plate swings back to its normal horizontal position once pressure is relieved, thereby closing the receptacle opening. Unfortunately, such a device often permits the door to contact trash thereinside and further accumulates trash on surfaces of the door, wherein since the door still requires touching by a patron/user during use sanitation concerns are prevalent.

Therefore, it is readily apparent that there is a need for an automatic solid surface access port and cover with an automatic cover that maintains a trash container out of sight, while providing easy access to the trash container via the cover that does not require touching and application of force by a patron/user, wherein the cover opens and closes automatically to permit trash to pass therethrough to a container therebelow without contamination of the cover and further uses a drive arm to facilitate controlled opening and closing of the cover.

BRIEF SUMMARY OF THE INVENTION

Briefly described, in a preferred embodiment, the present invention overcomes the above-mentioned disadvantages and meets the recognized need for such a device by providing for a self-contained automatic access port unit for a countertop comprising a proximity sensor that recognizes when waste is approaching an access port cover, wherein the sensor activates a direct current (DC) drive motor which moves a drive arm to open the cover plate to permit waste to drop through the access port into a trash container therebelow. Prior to passing into the trash container, trash may selectively be shredded, compacted and/or ground via a disposal mechanism. The automatic countertop access port could selectively be installed in any horizontal or vertical surface, or in surfaces angled between horizontal and vertical. By opening and closing automatically in response to trash approaching, the present invention prevents contamination of counter surfaces that might normally arise from contact with trash.

According to its major aspects and broadly stated, the present invention in its preferred form is a self-contained automatic access port unit for a countertop comprising a pivotally-operating cover plate, a drive arm, a means for moving the drive arm and a sensor. The automatic access port unit is disposed above an open top container. The drive arm is in mechanical communication with the motor and the pivotally-operating cover plate. Reverse movement of the motor urges the drive arm downward to open the pivotally-operating cover plate, thereby allowing the trash to fall through the access port to the open top container below.

The cover plate may be driven to close by forward movement of the motor urging the drive arm upward to close the pivotally-operating cover plate, or, alternately, via a spring that pulls the cover plate closed. Additionally, the automatic access port unit optionally comprises a timer in communication with the motor. The timer may selectively be programmed to activate the motor after a period of time. Activation of the timer signals forward movement of the motor. The automatic solid surface access port further comprises a housing member secured to one end of a spring, wherein the spring is also secured at its other end to the drive arm, or to the cover plate to urge movement of the pivotally-operating cover plate. The spring may comprise, for exemplary purposes, a clock spring.

In a preferred embodiment, the pivotally-operating access cover plate is preferably made of, or veneered with, the same material as the countertop surfaces to which it will be installed, thereby providing a less obtrusive and more aesthetically pleasing apparatus for disposing of refuse or other objects. It will be recognized by those skilled in the art that the motor is preferably a direct current drive motor, such as, for exemplary purposes only, a stepper motor that allows for up to one-hundred-and-eighty degree rotation of its shaft, and is powered using a controller and/or micro-controller to regulate the opening and/or closing of the pivotally-operating cover plate.

Additionally, the sensor recognizes when refuse is airborne and approaching the pivotally-operating cover plate. The sensor activates reverse movement of the motor to urge the drive arm downward, thereby opening the pivotally-operating cover plate. After motion is initiated by the motor, the momentum of the moving drive arm and cover plate causes continued motion of the cover plate into its open position. The pivotally-operating cover plate then remains open until activation of the timer. Activation of the timer after a selected period of time triggers the drive arm to close the pivotally-operating cover plate from the open position. Alternatively, or in conjunction with the motor, a spring gradually pulls the pivotally-operating cover plate against the counter opening thereby covering the open top container thereunder. The spring and momentum combination causes a slower, more controlled closure of the pivotally-operating cover plate, preventing potential injuries to fingers.

The automatic access port unit further comprises an electrical button in electrical communication with the motor, the sensor and the timer. With the cover plate open, the manually activated electrical touch switch once selected is used to hold open the lid for a preprogrammed amount of time. By pressing the switch for a second time, the lid is then released back to the automatic operation. The lid will then close. The location of the switch is on the apparatus surface or vicinity thereof. Once activated, the unit's automatic lid closure will be overridden and will keep the lid in the open position. In another embodiment, if the lid has not been released for a preprogrammed amount of time, the unit may automatically release the lid to return to its closed position. For example, the electrical button, when manually pushed, sends a pulse to briefly activate reverse movement of the motor, thereby urging the drive arm downward momentarily while imparting momentum to the drive arm to open the pivotally-operating cover plate from the closed position. Subsequently, after a period of time, activation of the timer sends a pulse to briefly trigger the motor to initiate closing of the pivotally-operating cover plate, as activation of the motor urges the drive arm momentarily to impart enough momentum to close the pivotally-operating cover plate from the open position. Alternatively, manually pressing the electrical button while the pivotally-operating cover plate is in the open position sends a similar pulse to activate immediate forward movement of the motor to generate enough momentum to close the pivotally-operating cover plate.

Once closed, the pivotally-operating cover plate engages with a sealing lip around the periphery of the automatic access port unit.

Pressing the second electrical hold button once while the cover plate is in the closed position deactivates the sensor, the motor and the timer. Pressing the second electrical hold button again activates the motor, the sensor and the timer. A single button programmed in the control circuit may perform the same task as the two separate buttons described. The single button will perform different tasks based on the position the cover plate is in at the time the button is pressed.

The automatic access port unit is disposed within a counter top. The counter top may comprise horizontal or vertical surfaces, and or angled surfaces in between. The automatic access port unit secures to the counter top via a bracket. The bracket may comprise, for exemplary purposes only, screws, adhesives, clamping devices, and the like.

Additionally, the automatic access port unit is disposed above an open top container. The motor is in mechanical communication with a solenoid. The solenoid comprises a base end and a piston end. The piston end comprises a piston. The solenoid pivots at both the base end and the piston end to open the pivotally-operating cover plate in an articulated fashion. Alternatively, the solenoid may be replaced by one or more hydraulic or pneumatic cylinders actuated by the electronic controls. Electrically actuated solenoids may be used to actuate the cylinder(s), thus opening and closing the access lid. These embodiments will have either a hydraulic or compressed air supply and or return lines to the unit. These lines will be supplied in addition to the electrical supply to control the access port unit. The control solenoids may be activated with the same signals currently controlling the drive motor. Many types of materials may be utilized for carrying the hydraulic or pneumatic pressures to and from the unit. This would be evident to one skilled in this type of application. These embodiments continue to allow the access port unit to be self contained, only needing the electrical and pneumatic or hydraulic lines connected.

More specifically, in a preferred embodiment, a self-contained automatic access port unit for a countertop, with method of use thereof, is provided, wherein an automatic solid surface access port comprises a pivotally-operating access cover plate, a drive arm in connection with the pivotally-operating access cover plate, a motor to urge the drive arm and a sensor that recognizes when refuse is airborne and approaching the cover plate. The drive arm reduces stress on the motor and requires less energy to hold the cover plate in an open or closed position. Thus, a more efficient and durable method of opening a pivotally-operating access cover plate is provided. The motor is preferably a direct current drive motor and more specifically, a gear reduced reversible drive motor.

In another preferred embodiment, the automatic solid surface access port further comprises at least one spring to assist movement of the pivotally-operating access cover plate. The spring stores and releases potential energy during the opening and/or closing of the cover plate, thereby reducing the amount of work needed to be done by the motor to generate movement of the cover plate. The spring is preferably a clock spring, although one skilled in the art would recognize any type of mechanism which is capable of storing potential energy, particularly different types of springs, would suffice and is contemplated in this disclosure. In a preferred embodiment, the spring, clock spring or additional tension devices have mechanical adjustments in order to set the desired tension.

In still another preferred embodiment, the automatic solid surface access port further comprises a worm gear reducer drive unit in mechanical communication with the motor. The worm gear reducer assists in locking the drive motor shaft in position once the motor is no longer energized. The worm gear reducer minimizes stress on the motor, increases motor durability, and minimizes the amount of energy necessary to run the motor, thereby increasing overall efficiency.

In yet another preferred embodiment, the automatic solid surface access port further comprises a mounting bracket to secure the automatic solid surface access port to a solid surface. Thus, the automatic solid surface access port is preferably mounted to any type of solid surface, thereby reducing the number of parts, materials and costs. Alternatively, the automatic solid surface access port further comprises an outer ring, wherein the mounting bracket is disposed on the outer ring.

In a preferred embodiment, the automatic solid surface access port further comprises a first beveled edge of the solid surface and a second beveled edge of the pivotally-operating access cover plate, wherein the second beveled edge of the pivotally-operating access cover plate sealedly engages the first beveled edge of the solid surface. Beveled edges provide a tighter seal between the cover plate and the solid surface, thereby forming a near air-tight seal which minimizes potential odors. In a further preferred embodiment the contact point of the cover plate and the solid surface is dampened by a gasket material, a seal, bumpers, or other suitable material as one skilled in the art would understand it, and any combination thereof. Additionally, the cover plate may be cut to be slightly smaller than the opening in the solid surface to allow space for a gasket material, a seal, bumpers or other type of insulation layer. An insulation layer further serves the purpose of reducing noise and shock of the lid when closing.

In another preferred embodiment, the automatic solid surface access port further comprises a locking mechanism, wherein the locking mechanism is preferably electrically activated. Providing a locking mechanism increases efficiency by not requiring a continuous stream of energy to hold open the cover plate. An electrical hold button may be utilized to signal the locking mechanism, wherein the bottom is disposed within the solid surface flushly to eliminate or reduce any raised areas in the solid surface and therefor provide a more aesthetically-pleasing design that may be cleaned easily.

In still another preferred embodiment, the automatic solid surface access port further comprises a roller wheel rotationally disposed on a first end of the drive arm, wherein the roller wheel is movably in communication with the pivotally-operating access cover plate. Thus, the roller wheel of the drive arm moves along the cover plate providing constant pressure and ensuring smooth opening and closing of the cover plate. In a further preferred embodiment, a track is provided to secure the roller wheel in contact with the pivotally-operating access cover plate. Although a roller wheel and track system is utilized in a preferred embodiment, one skilled in the art would recognize any type of system could be used which would maintain constant contact between the cover plate and the drive arm, such as, without limitation, a sliding mount recessed within a track.

In yet another preferred embodiment, the automatic solid surface access port further comprises a counter-weight disposed on a second end of the drive arm to offset the weight of the cover plate, thereby reducing the amount of energy required to open and close the cover plate.

In a preferred embodiment, the drive arm is spring actuated, thereby applying a more constant torque during communication between the drive arm and the cover plate while reducing the amount of energy necessary to move the cover plate. In another preferred embodiment, the roller wheel is also spring actuated, further increasing the torque applied to the lid while in the fully closed position and ensuring the point of connection between the solid surface and the cover plate is maintained in a near air-tight seal.

In a preferred use, a method of depositing trash into a trash container comprises the steps of sensing objects approaching an access door via a sensor, and disengaging the access door from a solid surface to permit the objects to pass through an aperture in the solid surface via a gear reduced reversible direct current drive unit. In a further preferred use, the gear reduced reversible direct current drive unit is in mechanical communication with a drive arm and movement of the drive arm by the gear reduced reversible direct current drive unit moves the cover plate. Thus, a sanitary method of disposing of trash is provided which decreases the amount of energy required to operate the trash disposal process, while also increasing efficiency of such process.

In another preferred use, the access port unit utilizes a preprogrammed electronic control unit. This control unit may consist of being a programmable logic controller (PLC), microchip, or microcontroller. Many different variations in the control units and program sequences may be utilized and would be evident to one skilled in these types of controls.

In another preferred use, the access port unit may either be installed into to the counter top from above utilizing the described attachment ring, or from below turning the counter top into the support structure. The attachment from below may incorporate a quick lock feature for attachment. This allows a bracket to be attached to the bottom of the countertop and then the access port unit to quick lock is connected to the bracket for easy installation and removal. An adhesive, anchors, and screw are among the preferred items of attachment of the apparatus or brackets. These and many other ways of attachment will be evident to one skilled in this type of application.

In another preferred use, a method of operating an automatic solid surface access port comprises the steps of sensing objects approaching a pivotally-operating access cover plate, moving a drive arm in an opening direction via a gear reduced reversible direct current drive unit, wherein the drive arm is in contact with the pivotally-operating access cover plate, disengaging the access door from a solid surface via movement of the drive arm to permit the objects to pass through an aperture in the solid surface, storing energy that is generated via the gear-reduced reversible direct current drive unit moving the pivotally-operating access cover plate in a spring, holding the cover plate in the open position by electrically activating holding latch, preferably an electromagnet, once releasing the latch, releasing the stored energy from the spring to assist movement of the drive arm in a closing direction, wherein the drive arm is in contact with the pivotally-operating access cover plate, and engaging the pivotally-operating access cover plate with the solid surface via movement of the drive arm. Thus an efficient and sanitary method of disposing of refuse is provided by reducing the number of parts and the amount of energy necessary to operate the automatic access port.

In an alternate embodiment, the cover plate seals to a ring surface via beveled edges, providing a near air-tight seal, thereby reducing and/or eliminating odors. It will be recognized by those skilled in the art that automatic countertop access port could be utilized for other applications wherein a door is desired to be opened for passage of objects or materials other than trash, such as for entry to a storage container for sports equipment, vapor or light transmission, or the like.

In a further alternate embodiment, an automatic countertop access port has a circular or oval ring and a cover plate, wherein the cover plate is opened via a linear solenoid and returned to the closed position via a spring. A limit switch restricts over-opening of the cover plate and also starts a timer to set a delay period. Following a pre-selected time delay, power to the solenoid is removed, and the potential energy stored in the stretched spring pulls the cover plate back into the closed position. Bumpers of metal, plastic or rubber dampen motion of the cover plate at the extremes of travel, wherein the bumpers may selectively be adjustable to facilitate alignment of the cover plate and ring.

In the alternate embodiment, the ring is flush mounted to a counter, wherein beveled edges on the cover plate and ring make contact when the cover plate is closed, to form an airtight or near air-tight seal. Additionally, a rubber-boot-covered locking mechanism can also be included to permit locking of the cover plate in the open position, such as might be required when servicing the access port or for use where it is desired to keep the access port open continuously, such as when peeling potatoes. The locking mechanism includes a sprung pin that engages a blindhole in a lever that connects the cover plate to the solenoid.

In the alternate embodiment, a proximity sensor is located on the ring, wherein the proximity sensor detects motion and/or proximity of trash approaching the automatic countertop access port. The sensor activates a linear solenoid, opening the cover plate before the arrival of trash at the automatic countertop access port, thereby permitting trash to fall through the aperture into a trash container therebelow. The solenoid comprises a body with a piston, and the body has a base end opposite the piston end, wherein the solenoid pivots at both the piston end and the base end of the solenoid to maintain the force from the solenoid piston directed from the cover, thereby applying maximum pulling force to the cover.

A level sensor detects when the container is full and provides indication of such status via an indicator. The indicator typically includes one or more lights or an audible sound or sounds of different pitch or duration, and selectively provides indication of different levels of trash within the container, as sensed by the level sensor. Further, the trash level sensor signals that the cover plate should not be opened once the trash level has reached a preprogrammed height.

The proximity and level sensors could be any suitable sensing device, such as, for exemplary purposes only, infrared, radio frequency, ultrasonic, light beam, imaging, or like sensors.

Additionally, a shedder, compactor and/or disposal may be provided below the aperture to operate on the trash prior to its passage into the container. Once full, the container may be removed from below the counter via an access door.

Thus, the preferred embodiment of the present invention provides automatic opening of the cover plate to avoid the need for human contact, thereby enhancing sanitary use of trash containers, in a more efficient manner with a more durable apparatus.

Accordingly, a feature and advantage of the present invention is its ability to prevent contact with possibly contaminated surfaces.

Another feature and advantage of the present invention is its ability to allow hands free use of a trash disposal unit.

Still another feature and advantage of the present invention is its ability to provide a more efficient method of disposing of refuse.

Yet another feature and advantage of the present invention is its ability to reduce the amount of energy necessary to operate an automatic access port.

Yet still another feature and advantage of the present invention is to provide a more durable automatic access port.

A further feature and advantage of the present invention is its ability to reduce stress on parts within an automatic access port.

Accordingly, a feature and advantage of the alternate embodiment of the present invention is its ability to sense the proximity of approaching trash and to dispose of same.

Another feature and advantage of the alternate embodiment of the present invention is its ability to automatically open to receive trash without contamination of the device cover from contact with the trash.

Still another feature and advantage of the alternate embodiment of the present invention is its ability to permit trash to be shredded, ground via a disposal and/or compacted.

Yet another feature and advantage of the alternate embodiment of the present invention is its ability to be mechanically or electrically locked open or closed.

Yet still another feature and advantage of the alternate embodiment of the present invention is its ability to sense the level of trash in a container.

A further feature and advantage of the alternate embodiment of the present invention is its ability to provide a tightly sealed surface.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATE EMBODIMENTS

Figure 1:
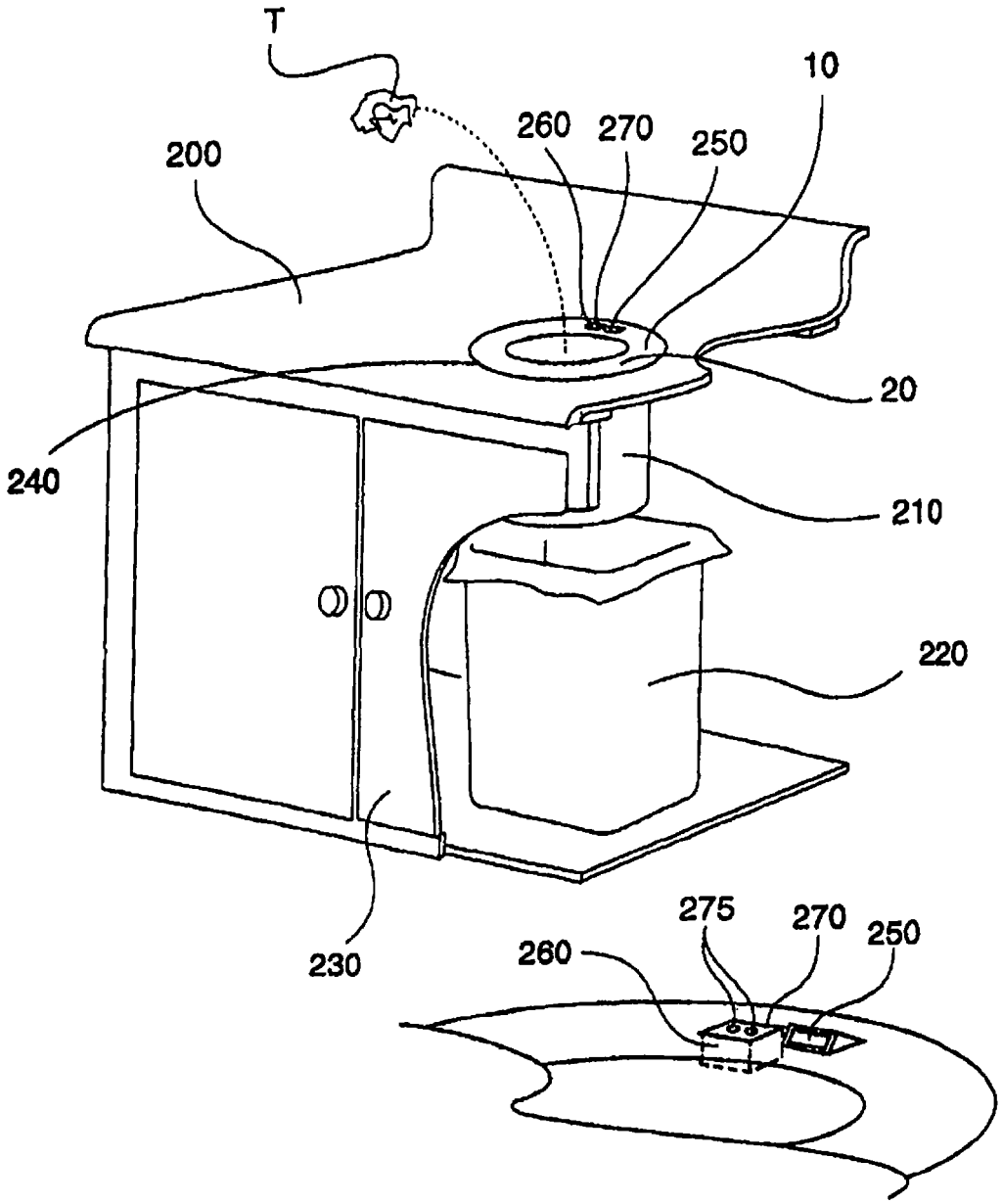
FIG. 1 is a perspective view of an automatic countertop access port according to an alternate embodiment of the present invention, shown installed in a countertop.
Figure 2A:
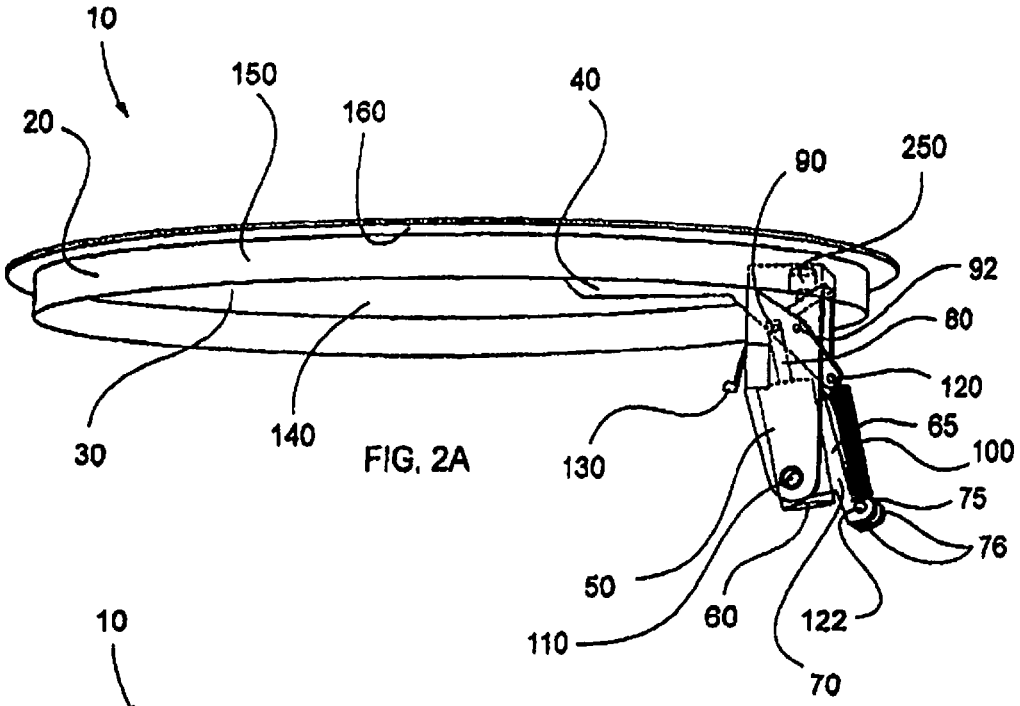
FIG. 2A is a perspective view of an automatic countertop access port according to an alternate embodiment of the present invention, shown closed.
Figure 2B:
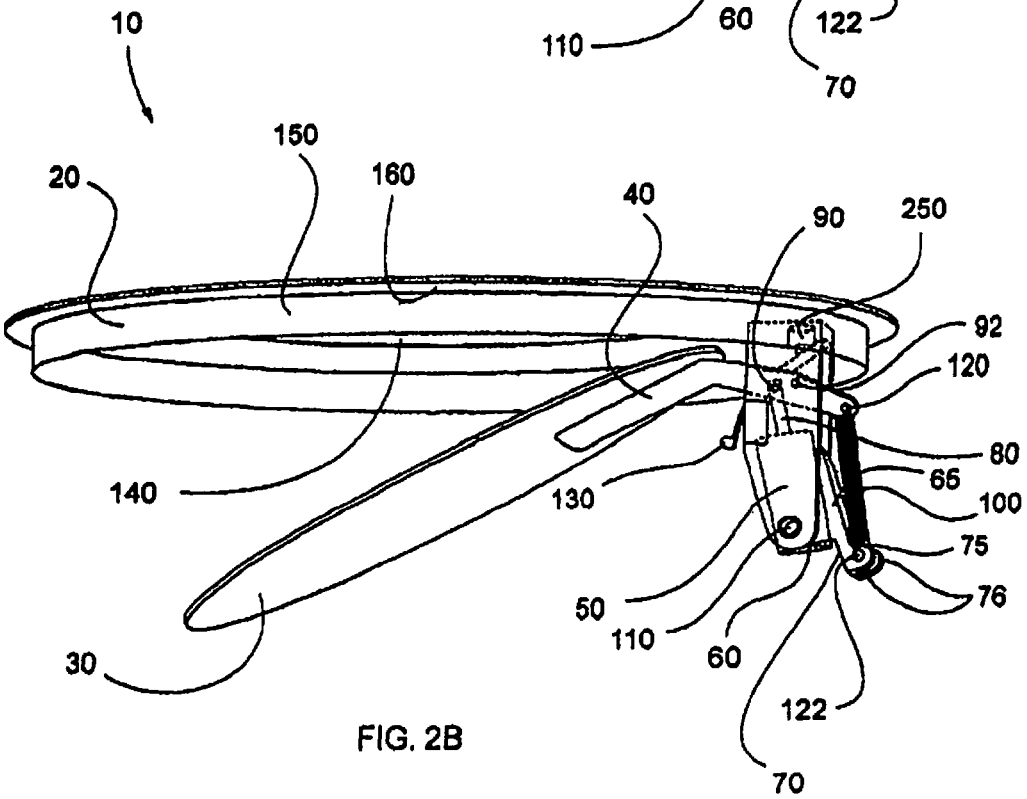
FIG. 2B is a perspective view of an automatic countertop access port according to an alternate embodiment of the present invention, shown partially opened.
Figure 2C:
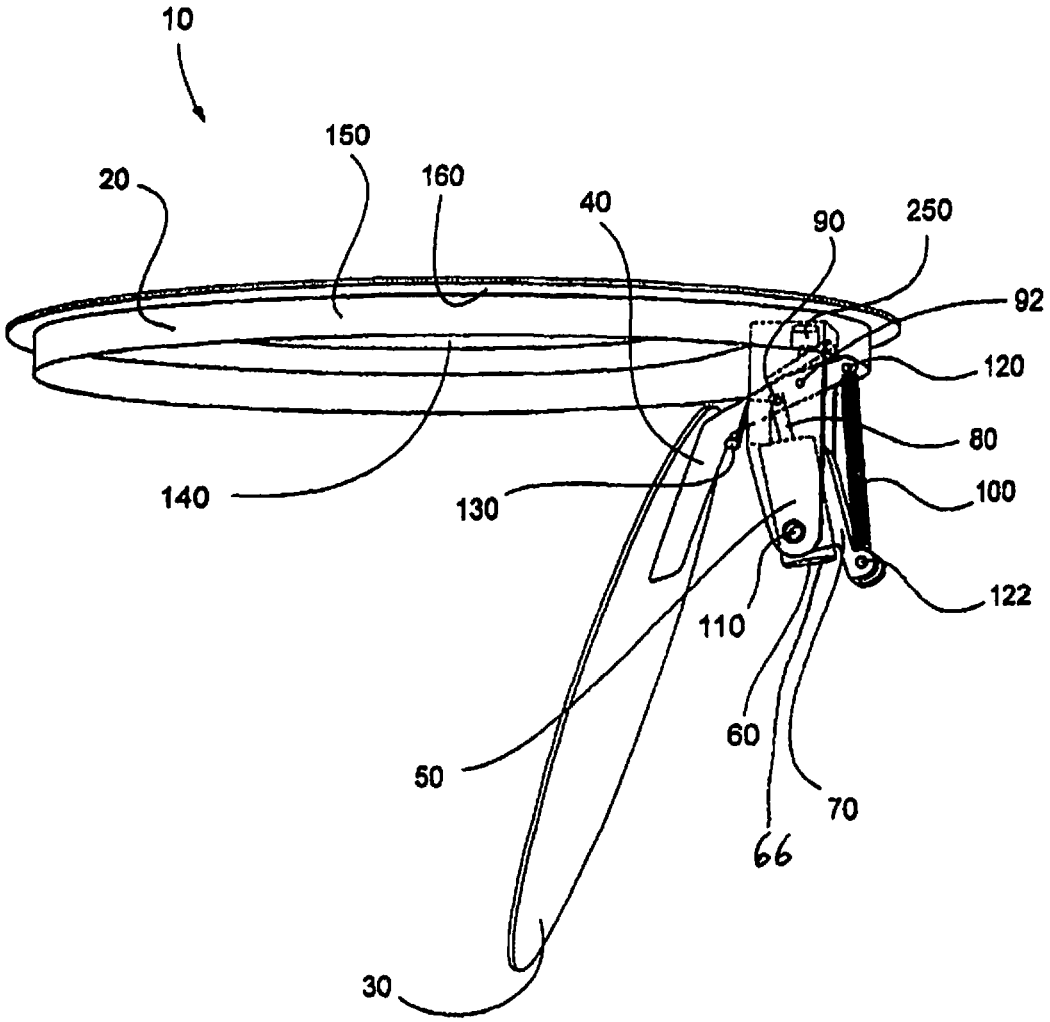
FIG. 2C is a perspective view of an automatic countertop access port according to an alternate embodiment of the present invention, shown fully opened.

In describing the preferred and selected alternate embodiments of the present invention, as illustrated in FIGS. 1-6, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1-3A, the present invention in an alternate embodiment is automatic access port unit 10, comprising circular or oval ring 20, cover plate 30, lever 40, mount 50, linear solenoid 60, optionally at least one hydraulic cylinder 66, housing 70, spring 100 and limit switch 130, wherein linear solenoid 60 comprises body 65 and piston 80. It will be recognized by those skilled in the art that ring 20 and cover plate 30 could comprise alternate shapes, including, without limitation, square, rectangular, etc. Additionally, cover plate 30, comprises any type of material, including, but not limited to granite, CORIAN, stone, metal, veneer on a subsurface and/or any combination thereof, although one which matches or is of the same material as counter 200 is preferred.

When closed, cover plate 30 is disposed within ring 20, wherein cover plate 30 and ring 20 form an air-tight or near air-tight seal. Lever 40 comprises upper spring bearing 120 and upper pivot 90, wherein upper pivot 90 comprises a bearing and lever 40 is pivotally secured via upper pivot 90 to piston 80 of solenoid 60, and wherein lever 40 is fixedly secured to cover plate 30. Mount 50 is fixedly secured to ring 20, wherein mount 50 carries therewithin solenoid 60, and wherein solenoid 60 is disposed within housing 70. Body 65 of solenoid 60 is pivotally secured to mount 50 via lower pivot 110, wherein lower pivot 110 comprises a roller bearing. Lever 40 could alternately be additionally pivotally-constrained within mount 50 via bearing 92.

Housing 70 comprises legs 75, feet 76 and lower pivot 110, wherein feet 76 comprise lower spring pivot 122. Spring 100 is secured to upper spring pivot 120 and lower spring pivot 122, wherein spring 100 provides return force for closure of cover plate 30. Spring pivots 120, 122 comprise a bearing or bushing to reduce frictional forces to spring 100, and to facilitate closing motion of cover plate 30. It will be recognized by those skilled in the art that cover plates 30 could comprise a counterweight for closing force, in lieu of spring 100.

Limit switch 130 is disposed on mount 50, wherein limit switch 130 is contacted by cover plate 30 when cover plate 30 is opened. Upon contact by cover plate 30, limit switch 130 begins a time delay period to disconnect power to solenoid 60, and further prevents damage to cover plate 30 and lever 40.

Ring 20 is flush mounted to counter 200 and comprises aperture 140, flange 150 and rim 160. Trash sensor 250, which is also preferably flush mounted to counter 200, is a proximity sensor and is preferably disposed within counter 200 or alternatively on ring 20, wherein trash sensor 250 detects motion or proximity of trash T approaching and activates linear solenoid 60 to open cover plate 30, thereby pulling cover plate 30 downward to permit trash T to fall through aperture 140 into container 220 therebelow (best shown in FIG. 1). As necessary, trash sensor 250 uses mirrors or other reflective surfaces to project from beneath the surface of counter 200, thereby scanning a larger space above automatic access port unit 10. Cover plate 30 is drawn downward to open via linear solenoid 60, wherein solenoid 60 pivots steadily to maintain optimum force throughout the opening of cover plate 30.

Bumpers 400, 410 are disposed on ring 20 and dampen motion of cover plate 30 via contact with lever 40 at the extremes of travel thereof. Bumpers 400, 410 comprise sloped surfaces 420, 430, respectively. Bumpers 400, 410 comprise metal or, alternately, could comprise rubber. Sloped surface 420 makes contact with lever 40 when cover plate 30 is fully closed, wherein sloped surface 420 comprises rubber coating 421. Sloped surface 430 makes contact with lever 40 when cover plate 30 is fully open, wherein sloped surface 430 comprises rubber coating 431.

Figure 3B:
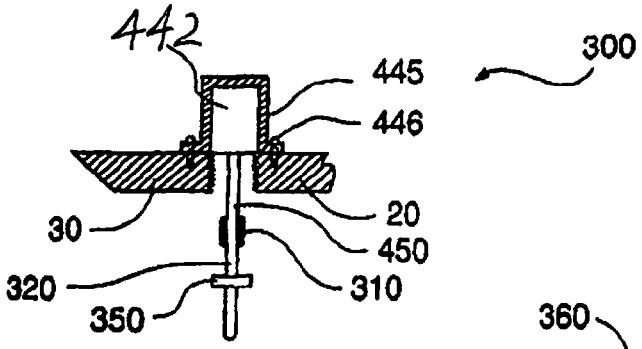
FIG. 3B is a detail side view of a solenoid locking component of an automatic countertop access port according to an alternate embodiment of the present invention.
Figure 3A:
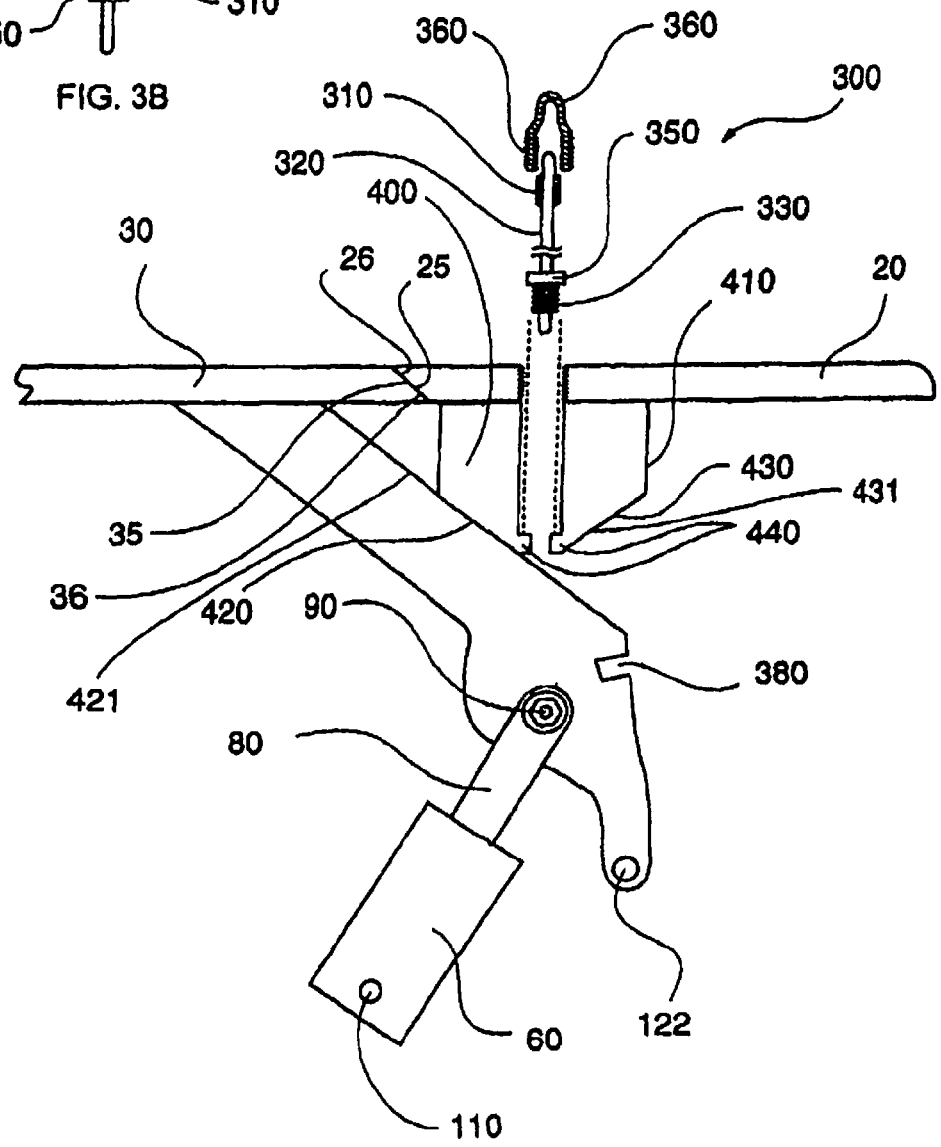
FIG. 3A is a detail side view of an automatic countertop access port according to an alternate embodiment of the present invention.

Refers now more particularly to an alternate embodiment as shown in FIG. 3A, ring 20 comprises bevel 25 and cover plate 30 comprises bevel 35. In the fully closed state shown in FIG. 3, bevel 35 of cover plate 30 is disposed proximate bevel 25 of ring 20, thereby forming a near air-tight seal. Bevels 25, 35 comprise rubber coating 26, 36 to provide an efficient seal for dampening sound and reducing odors.

Automatic access port unit 10 could optionally comprise locking mechanism 300, wherein locking mechanism 300 comprises threaded body 310, pin 320, spring 330, flange 350 and rubber boot 360. Bumpers 400, 410 comprise ridges 440 and are disposed proximate threaded body 310 of locking mechanism 300.

In an alternate embodiment, pin 320 is slidably disposed within threaded body 310, wherein spring 330 is disposed over pin 320. Spring 330 is retained via flange 350 and ridges 440, wherein spring 330 tends to urge pin 320 to its original position subsequent to removal of depressive force. Rubber boot 360 is disposed over pin 320 and threaded body 310 to prevent moisture incursion to locking mechanism 300. Pin 320 selectively engages blindhole 380 in lever 40, wherein cover plate 30 is rendered immobile while pin 320 is so engaged. Interference between pin 320 and blindhole 380 under tension of spring 100 acting on lever 40 holds pin 320 within blindhole 380 overcoming the urging force of spring 330. Slightly tapping on cover plate 30 releases interference and permits pin 320 to retract and withdraw from blindhole 380, thereby permitting spring 100 to close cover plate 30.

In a further alternate embodiment of the present invention shown in FIG. 3B, locking mechanism 300 could comprise second solenoid 442 secured via holddown 445 and fasteners 446, wherein solenoid piston 450 replaces pin 320, and wherein solenoid piston 450, upon activation via a switch, electromagnetically engages blindhole 380. In a further alternate embodiment, second solenoid 442 could drive pin 320, wherein solenoid piston 450 is in communication with pin 320. Alternately, second solenoid 442 could be mounted below ring 20 and adapted to engage blindhole 380 via a linkage.

In a preferred embodiment, electrical hold button 505 (best shown in FIG. 4) is depressed, thereby holding cover plate in an open position. First electrical hold button 505 is preferably pressed again to thereby allow cover plate 30 to return to a closed position. First electrical hold button 505 preferably electrically prevents closure of cover plate 30. Alternatively, first electrical hold button 505 engages and disengages pin 320. In an additional embodiment, first electrical hold button 505 activates second solenoid 442. First electrical hold button 505 is preferably disposed within counter 200 in a substantially flat position, level and flush with counter 200, thereby eliminating or reducing any raised areas in counter 200 to ease in cleaning and producing a more aesthetically pleasing design.

In one embodiment, first electrical hold button 505 is in communication with motor 510. Pressing first electrical hold button 505 once while cover plate 30 is open sends a pulse to activate brief reverse movement of motor 510 and to keep cover plate 30 open utilizing an electrically-actuated latch, such as, for exemplary purposes only, an electromagnet, wherein upon release of the electrically-actuated latch when cover plate 30 is in the closed position, cover plate 30 is opened. Pressing first electrical hold button 505 again sends a pulse to activate brief forward movement of motor 510 to close cover plate 30 from the open position, again with cover plate 30 being carried to the closed position by generated momentum. In a variation of this alternate embodiment, first electrical hold button 505 may selectively be required to be engaged for a period of time before cover plate 30 is activated to close.

Additionally, in another embodiment, automatic access port unit 500 further comprises second electrical hold button 506, wherein second electrical hold button 506 is in communication with motor 510, sensor 250 and timer 503. Pressing second electrical hold button 506 once while cover plate 30 is in the closed position, deactivates motor 510, sensor 250 and timer 503. Pressing second electrical hold button 506 again activates motor 510, sensor 250 and timer 503.

In another preferred embodiment, first electrical hold button 505 and second electrical hold button 506 are a single button. The functions of first electrical hold button 505 and second electrical hold button 506 are thus programmed into the electronic control circuit and a single button perform the different tasks when pressed based on the preprogrammed needs and the position of cover plate 30.

To install an alternate embodiment of the present invention, automatic countertop access port unit 10 is disposed within counter 200, wherein ring 20 rests on and within opening 240 in counter 200. Automatic countertop access port unit 10 provides aperture 140 for passage of trash T through counter 200 into container 220 therebelow. A shedder, compactor and/or disposal 210 may selectively be provided below aperture 140 to perform desired actions on trash T prior to its passage into container 220. Container 220 may be removed from below counter 200 via access door 230.

In an alternate use, trash T is sent to the vicinity of cover plate 30, wherein sensor 250 detects the presence of trash T and activates solenoid 60, thereby opening cover plate 30 and permitting trash T to pass through aperture 140. After a preselected time delay, power to solenoid 60 is removed, and potential energy stored in stretched spring 100 pulls cover plate 30 back to the closed position shown in FIG. 2A. It will be recognized by those skilled in the art that cover plate 30 could alternately be opened by remote control. Alternatively, at least one pneumatic or hydraulic cylinder 66, may replace solenoid 60, wherein at least one hydraulic cylinder 66 opens cover plate 30.

Figure 4:
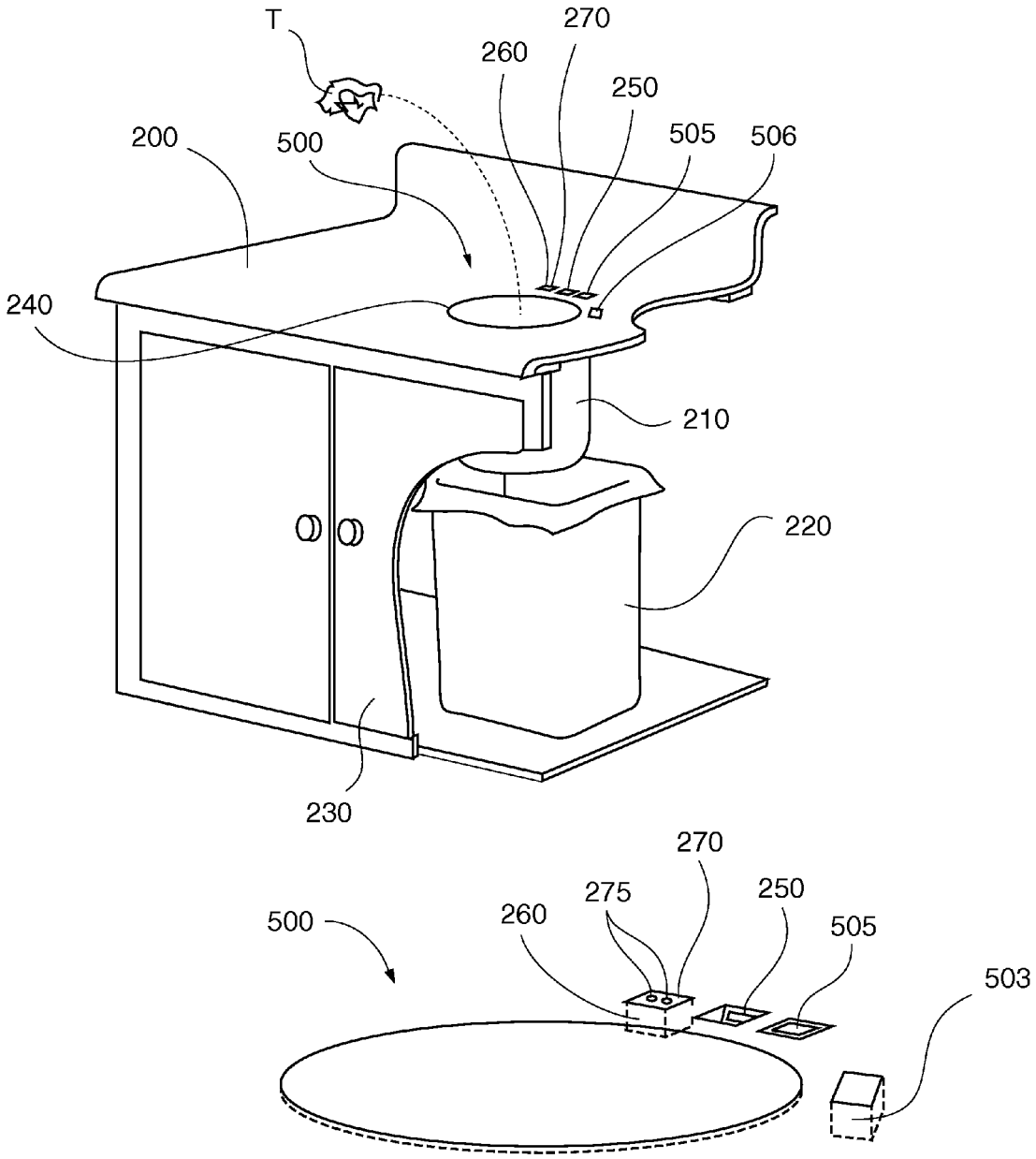
FIG. 4 is a perspective view of an automatic solid surface access port according to a preferred embodiment of the present invention, shown installed in a countertop.

Referring now to FIGS. 1 and 4, in the alternate and preferred embodiments therein, level sensor 260 preferably comprises indicator 270, wherein level sensor 260 is preferably directionally disposed toward container 220 and preferably detects when container 220 is full, thereby preferably providing indication of such status via indicator 270. Indicator 270 typically comprises one or more lights 275, wherein lights 275 could selectively provide indication of different levels of trash T within container 220 sensed by level sensor 260. It will be recognized by those skilled in the art that other indicators, such as, for exemplary purposes only, audible sounds, could be utilized in lieu of lights 275. Sensors 250, 260 comprise any suitable sensing device, such as, for exemplary purposes only, infrared, radio frequency, ultrasonic, light beam, imaging, or like sensors.

To install, automatic countertop access port unit 10 is installed in counter 200 and is secured in place by suitable fasteners, such as, for exemplary purposes only, screws, adhesives, clamping devices, quick locking devices, and the like. Further, electrical and/or pneumatic/hydraulic lines are connected to automatic countertop access port unit 10, thereby rendering automatic countertop access port unit 10 operational.

Figure 5A:
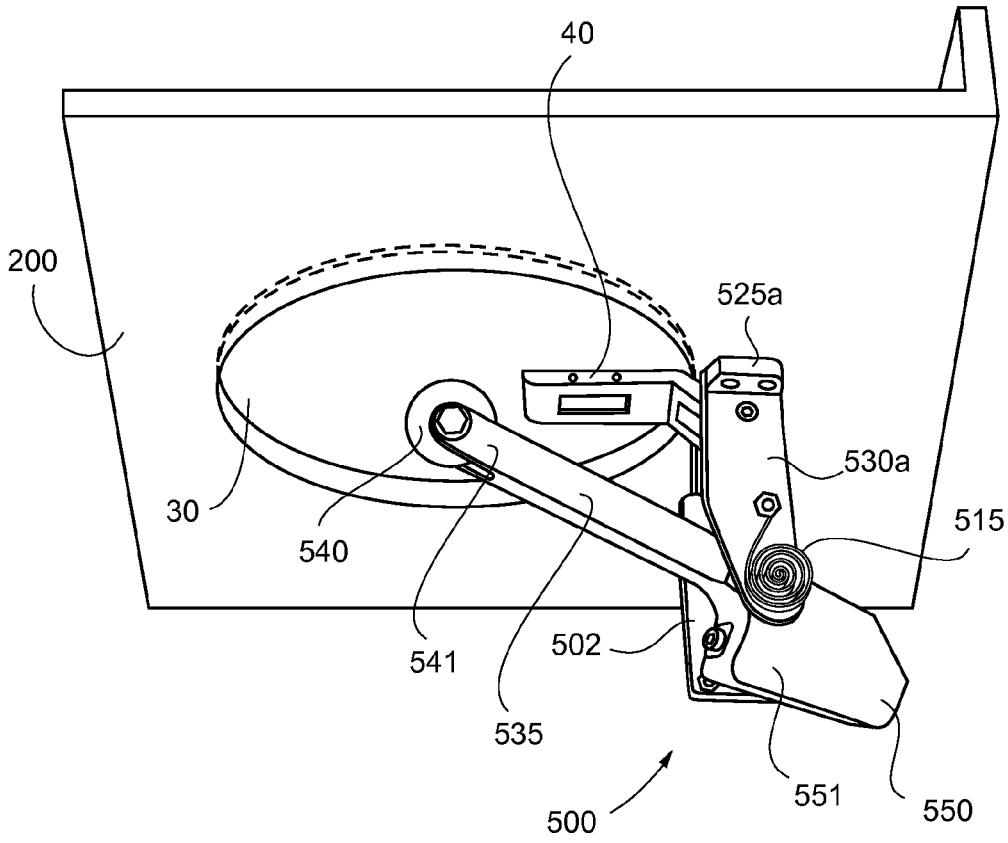
FIG. 5A is a perspective view of an automatic solid surface access port according to a preferred embodiment of the present invention, shown closed.
Figure 5B:
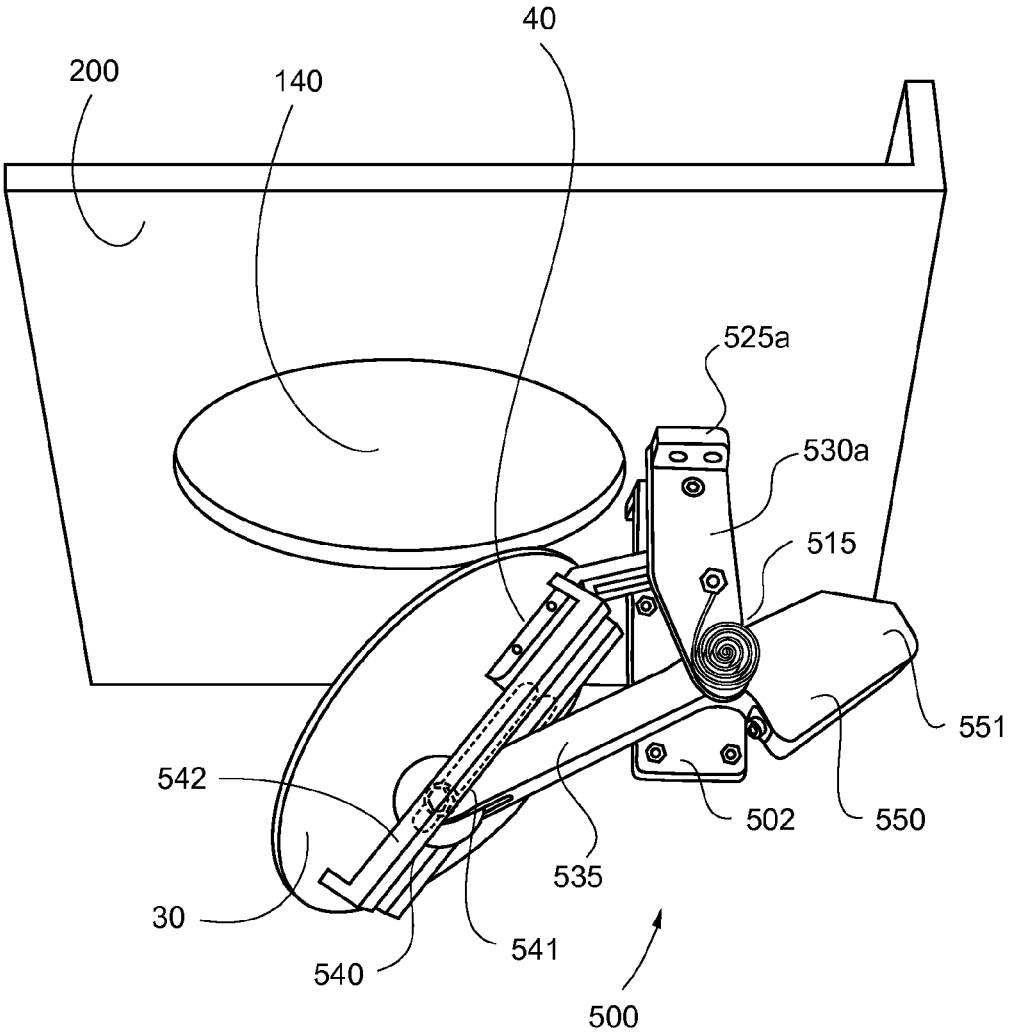
FIG. 5B is a perspective view of an automatic solid surface access port according to a preferred embodiment of the present invention, shown partially opened.
Figure 6:
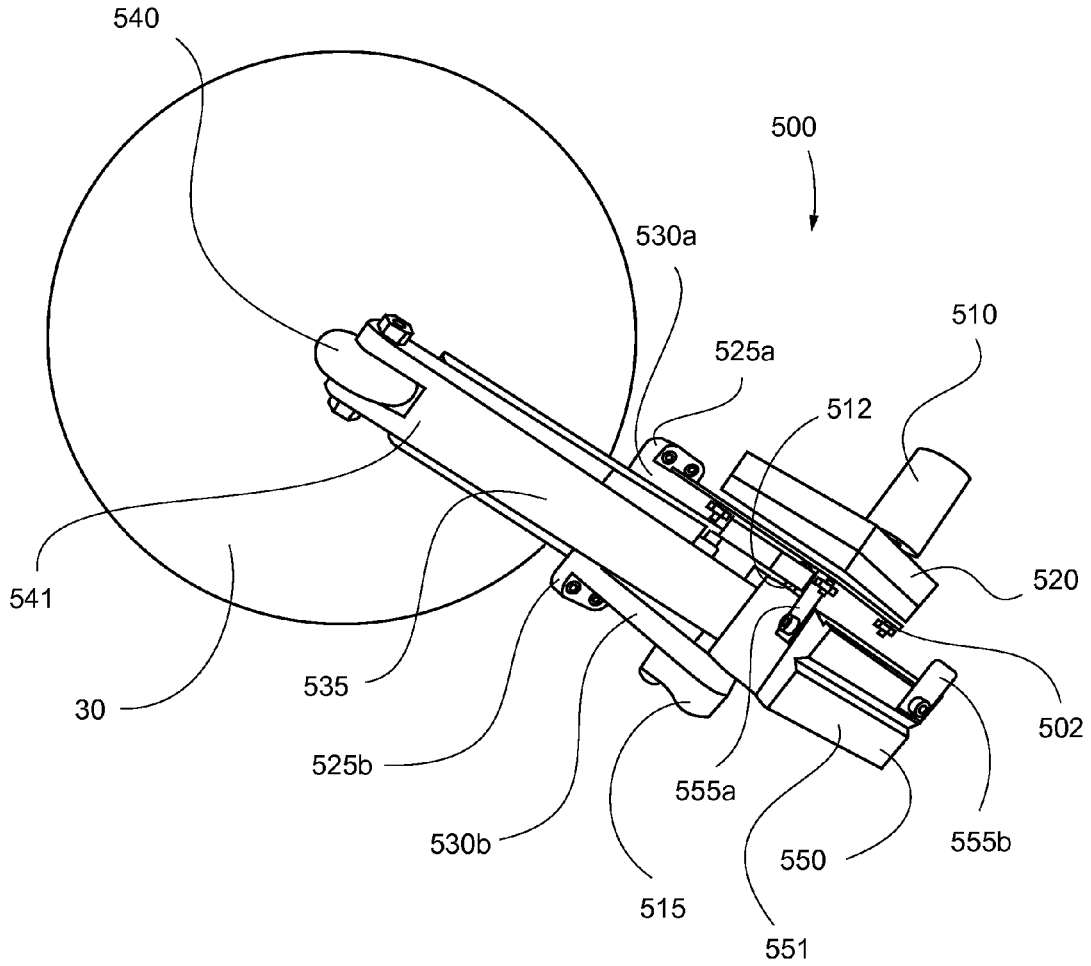
FIG. 6 is a perspective view of an automatic solid surface access port according to a preferred embodiment of the present invention, shown from the bottom.

Referring now to FIGS. 4-6, the present invention in a preferred embodiment is automatic access port unit 500, preferably comprising cover plate 30, lever 40, mounting plate 502, timer 503, motor 510, spring 515, reducer 520, left mount 525*a*, right mount 525*b*, left fork 530*a*, right fork 530*b*, drive arm 535, wherein drive arm has first end 541 and second end 551, roller wheel 540, counterweight 550 and limit switches 555*a* and 555*b*, and wherein motor 510 provides for shaft rotation of up to approximately one-hundred-and-eighty degrees. Left and right mounts 525*a*, 525*b* are secured to countertop 200 via fasteners as are known in the art. Timer 503 is in communication with motor 510, wherein timer 503 is selectively programmed to activate after a period of time, and wherein activation of timer 503 sends a pulse to motor 510 to reverse and rotate in its opposite movement direction to close cover plate 30. It will be recognized by those skilled in the art that cover plate 30 could comprise alternate shapes, including, without limitation, square, rectangular, etc.

Still referring now to FIGS. 4-6, automatic access port unit 500 comprises sensor 250 and motor 510, wherein sensor 250 sends a pulse to activate brief reverse movement of motor 510 to urge drive arm 535 downward and thusly cover plate 30 downward, thereby exposing container 220. The initial pulse to motor 510 imparts momentum to motor 510, drive arm 535 and cover plate 30, carrying cover plate 30 into the open position, wherein cover plate 30 remains open until timer 503 is further activated. Cover plate 30 is held open with an electrically-activated locking device, as described hereinabove. Further activation of timer 503 releases the electrically-activated locking device and sends a pulse to activate brief forward movement of motor 510 to urge drive arm 535 upward to close cover plate 30, wherein momentum of cover plate 30, drive arm 535 and motor 510 and potential energy in spring 515, gradually pull cover plate 30 toward opening 240, thereby covering container 220 (as shown in FIG. 1) in such a controlled manner as to prevent possible injuries to a user's fingers near cover plate 30. Further, this alternate embodiment could include ring 20, wherein engagement of cover plate 30 with ring 20 (best shown in FIG. 1) provides a seal to provide a uniform impervious surface to counter 200.

In a preferred embodiment, when automatic access port unit 500 is closed, as best shown in FIG. 5A, cover plate 30 is preferably disposed within opening 240 of counter 200, wherein opening 240 and cover plate 30 preferably form an air-tight or near air-tight seal, and wherein counter 200 may comprise horizontal surfaces, vertical surfaces or surfaces angled between horizontal and vertical. Left mount 525*a* and right mount 525*b* connect to counter 200 by any manner known in the art, including, but not limited to screws, adhesives, clamping devices and/or any combination thereof. Lever 40 is preferably pivotally mounted between left fork 530*a* and right fork 530*b* and preferably fixedly mounted to cover plate 30. Further, drive arm 535 is also preferably pivotally mounted between left fork 530*a* and right fork 530*b* around motor drive shaft 512. Left fork 530*a* and right fork 530*b* further preferably comprise bearing assemblies (not shown) to allow drive arm 535, motor drive shaft 512 and spring 515 to be a single unit and reduce friction between movable pieces.

In a preferred embodiment, motor 510 is preferably in mechanical communication with reducer 520 and timer 503, wherein timer 503 is in communication with motor 510. Although one skilled in the art would recognize almost any type of motor could be used, specifically a direct current (DC) gear reduced reversible drive motor is contemplated. Reducer 520 is in communication with motor 510, wherein reducer 520 may be any type of gear reducer to assist in holding motor drive shaft 512 in position when motor 510 is not energized, but is preferably a worm gear reducer drive. Reducer 520 is preferably disposed on mounting plate 502, but may be mounted on other substantially non-movable surfaces such as left fork 530*a* and 530*b*. Motor drive shaft 512 is preferably in mechanical communication with reducer 520 and drive arm 535 and as reducer 520 rotates drive motor shaft 512, drive arm 535 is preferably driven in either an upward or downward direction dependant on rotational direction of reducer 520 and motor drive shaft 512. Motor drive shaft 512 preferably is further in mechanical communication with spring 515. Spring 515 is preferably a clock spring although one skilled in the art would recognize any type of device for storing energy could be utilized. Motor drive shaft 512 preferably tensions spring 515 as it rotates, storing energy in spring 515 which may be utilized to counter the weight of cover plate 30 and/or allow cover plate 30 to return to a closed position where cover plate 30 is in contact with counter 200.

In a preferred embodiment, drive arm 535 preferably comprises first end 541 and second end 551, wherein roller wheel 540 is preferably disposed on first end 541 of drive arm 535 to preferably allow lateral movement of drive arm 535 in relation to cover plate 30, thus opening or closing cover plate 30 dependant on directional movement of drive arm 535, and counterweight 550 is preferably disposed on second end 551 of drive arm 535, thereby reducing force necessary to move drive arm 535. Selective use of different weights of counterweight 550 facilitates the use of different weights of cover plate 30 as desired. Although roller wheel 540 is specifically contemplated, one skilled in the art would recognize other types of mechanisms which allow drive arm 535 to move across cover plate 30 while maintaining contact between cover plate 30 and drive arm 535, such as sliding pieces, would function as well. As motor 510 rotates, reducer 520 preferably rotates motor drive shaft 512, thus rotating drive arm 535, preferably moving roller wheel 540 along cover plate 30 and opening or closing cover plate 30 dependent on directional rotation of motor drive shaft 512. In an alternate embodiment, roller wheel 540 sits within track 542 (best shown in FIG. 5B) disposed on underside of cover plate 30, which keeps roller wheel 540 and cover plate 30 in contact when cover plate 30 is opened and closed. Additionally, roller wheel 540 is preferably spring actuated to allow for a more constant torque to be applied to cover plate 30 while cover plate 30 is in the fully closed position. Further, limit switches 555*a*, 555*b*, which are preferably disposed on second end 551 of drive arm 535, give feedback to the electronic control unit to limit movement of drive arm 535 in each direction. One skilled in the art would recognize limit switches 555*a*, 555*b* must not necessarily be disposed on second end 551 of drive arm 535 and may be disposed in other positions which would serve to give position feedback of drive arm 535 to the electronic control unit to limit movement of drive arm 535.

Opening 240 within counter 200 is preferably beveled in a direction as to mate with beveled cover plate 30. In the fully closed state shown in FIGS. 2A, 3A, and 5A, beveled edge of cover plate 30 is preferably disposed proximate beveled edge of counter 200, thereby preferably forming a near air-tight seal. In an alternate embodiment, beveled edge of counter 200 and beveled edge of cover plate 30 further comprise rubber coating 26, 36, such as gaskets or bumpers, to provide an efficient seal, reduce shock and dampen sound. Alternatively, cover plate 30 is made slightly smaller than opening 240 in counter 200 to prevent contact between cover plate 30 and inner edge of opening 240 in counter. The small gap caused by the differentiation in size may be filled with gaskets, bumpers or similar material.

In a preferred use, trash T is preferably sent to the vicinity of cover plate 30, wherein sensor 250 preferably detects the presence of trash T and preferably pulses motor 510, thereby opening cover plate 30 and permitting trash T to pass through opening 240 in counter 200. An electrically activated locking device, preferably electromagnet, holds cover plate 30 open. After a pre-selected time delay, the holding device is removed, motor 510 is pulsed, and potential energy stored in spring 515 preferably pulls cover plate 30 back to the closed position shown in FIGS. 2A, 3A and 5A. It will be recognized by those skilled in the art that cover plate 30 could alternately be opened by remote control. Alternatively, power to motor 510 could be used to close cover plate 30 and energy stored spring 515 could be used to open cover plate 30. In an alternate embodiment motor 510 is utilized for both the opening and closing procedure.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A self-contained, automatic access port unit for installation into a solid counter surface, said access port unit comprising:

a pivotally-operating cover plate; and an operational mechanism, wherein said operational mechanism comprises a drive arm in communication with said pivotally-operating cover plate;

a motive mechanism to urge said drive arm, wherein forward movement of said motive mechanism urges said drive arm and said pivotally-operated cover plate upward to close said pivotally-operating cover plate, and wherein reverse movement of said motive mechanism urges said drive arm and said pivotally-operated cover plate downward to open said pivotally-operating cover plate;

a sensor, wherein said sensor recognizes approaching refuse while the refuse is in approach to said pivotally-operating cover plate; and a timer in communication with said motive mechanism, wherein said timer is selectively programmed to activate after a period of time, and wherein said activation of said timer signals said motive mechanism to reverse its movement direction.

2. A self-contained, automatic access port unit for installation into a solid counter surface, said access port unit comprising:

a pivotally-operating cover plate comprising a beveled outer edge; and an operational mechanism, wherein said operational mechanism comprises a drive arm in communication with said pivotally-operating cover plate;

a motive mechanism to urge said drive arm, wherein forward movement of said motive mechanism urges said drive arm upward to close said pivotally-operating cover plate, and wherein reverse movement of said motive mechanism urges said drive arm downward to open said pivotally-operating cover plate;

a sensor, wherein said sensor recognizes approaching refuse while the refuse is in approach to said pivotally-operating cover plate; and an outer ring, wherein said outer ring is adapted to be disposed on a top portion of the solid counter surface, and comprising a beveled internal edge, and wherein when said beveled internal edge and said beveled outer edge are in contact with one another, they form a sealed surface.

3. The self-contained, automatic access port unit of claim 2, wherein said sensor activates said reverse movement of said motive mechanism to urge said drive arm downward, and wherein said drive arm opens said pivotally-operating cover plate, further comprising a timer in communication with said motive mechanism, and wherein said pivotally-operating cover plate remains open until said activation of said timer.

4. The self-contained, automatic access port unit of claim 3, wherein said activation of said timer after said period of time triggers said motive mechanism to start said drive arm to close said pivotally-operating cover plate from an open position, and wherein momentum from said motive mechanism starting said drive arm to close and potential energy in said at least one spring gradually pulls said pivotally-operating cover plate closed, thereby causing slow closure of said pivotally-operating cover plate and preventing injuries to fingers by said pivotally-operating cover plate.

5. The self-contained, automatic access port unit of claim 4, further comprising a first electrical switch in communication with said motive mechanism, wherein pressing said first electrical switch activates said reverse movement of said motive mechanism to open said pivotally-operating cover plate when said pivotally-operating cover plate is in the closed position.

6. The self-contained, automatic access port unit of claim 5, wherein pressing said first electrical switch activates said forward movement of said motive mechanism to close said pivotally-operating cover plate when said pivotally-operating cover plate is in the open position.

7. The self-contained, automatic access port unit of claim 6, further comprising a second electrical switch in electrical communication with said motive mechanism, said sensor and said timer, wherein pressing said second electrical switch once deactivates said sensor, said motive mechanism and said timer, and wherein said first electrical switch can be programmed to deactivate said reverse movement of said motive mechanism upon first being pressed to keep said pivotally-operating cover plate in said open position and to reactivate said reverse movement upon being pressed a second time.

8. The self-contained, automatic access port unit of claim 7, wherein pressing said second electrical switch a second time activates said motive mechanism, said sensor and said timer.

9. The self-contained, automatic access port unit of claim 7, wherein the first electrical switch and the second electrical switch are a single electrical switch with different programmable functions.

10. The self-contained, automatic access port unit of claim 2, wherein the beveled internal edge comprises a rubber coating.

11. The self-contained, automatic access port unit of claim 2, wherein the beveled outer edge comprises a rubber coating.

12. A self-contained, automatic access port unit for installation into a solid counter surface, said access port unit comprising:

a pivotally-operating cover plate; and an operational mechanism, wherein said operational mechanism comprises a drive arm in communication with said pivotally-operating cover plate;

a motive mechanism to urge said drive arm, wherein forward movement of said motive mechanism urges said drive arm upward to close said pivotally-operating cover plate, and wherein reverse movement of said motive mechanism urges said drive arm downward to open said pivotally-operating cover plate;

a sensor, wherein said sensor recognizes approaching refuse while the refuse is in approach to said pivotally-operating cover plate; and a roller wheel disposed on a first end of said drive arm, wherein said roller wheel is disposed in rolling contact with said pivotally-operating cover plate, and wherein said roller wheel rolls across said pivotally-operating cover plate as said pivotally-operating cover plate is moved, and wherein said roller wheel is optionally spring actuated.

13. The self-contained, automatic access port unit of claim 12, further comprising:

a track, wherein said track secures said roller wheel in contact with said pivotally-operating cover plate.

14. The self-contained, automatic access port unit of claim 13, further comprising a counter-weight disposed on a second end of said drive arm.

15. A countertop with self-activating trash opening, said countertop comprising:

a counter surface;

a self-contained, automatic access port unit comprising:

a pivotally-operating cover plate; a an operational mechanism, wherein said operational mechanism comprises a drive arm in communication with said pivotally-operating cover plate;

a motive mechanism to urge said drive arm, wherein forward movement of said motive mechanism urges said drive arm and said pivotally-operated cover plate upward to close said pivotally-operating cover plate, and wherein reverse movement of said motive mechanism urges said drive arm and said pivotally-operated cover plate downward to open said pivotally-operating cover plate;

a sensor, wherein said sensor recognizes approaching refuse while the refuse is in approach to said pivotally-operating cover plate; and a timer in communication with said motive mechanism, wherein said timer is selectively programmed to activate after a period of time, and wherein said activation of said timer signals said motive mechanism to reverse its movement direction.

16. The countertop of claim 15, wherein said counter surface is selected from the group consisting of horizontal surfaces, vertical surfaces and combinations thereof.

17. The countertop of claim 16, wherein said pivotally-operated cover plate secures to said counter surface via a fastener selected from the group consisting of screws, adhesives, clamping devices, quick locking devices, and combinations thereof.

18. A self-contained, automatic access port unit installable into a solid counter surface, said access port unit comprising:

a pivotally-operating cover plate; and an operational mechanism, wherein said operational mechanism comprises a drive arm in communication with said pivotally-operating cover plate;

a motive mechanism to urge said drive arm, wherein forward movement of said motive mechanism urges said drive arm upward moving the pivotally operated cover plate upward toward the solid counter surface after installation therein to close said pivotally-operating cover plate, wherein reverse movement of said motive mechanism urges said drive arm and said pivotally-operating cover plate downward to open said pivotally-operating cover plate; and a sensor, wherein said sensor recognizes approaching refuse while the refuse is in approach to said pivotally-operating cover plate.

19. The self-contained, automatic access port unit of claim 18, further comprising a housing member, wherein said housing member attaches to at least one spring, and wherein said at least one spring assists movement of said pivotally-operating cover plate.

20. The self-contained, automatic access port unit of claim 18, wherein said motive mechanism is selected from the group consisting of drive motors, solenoids, hydraulic cylinders, pneumatic cylinders and combinations thereof.

* * * * *